US005898355A

United States Patent [19]

Yu

[11] Patent Number: 5,898,355

[45] Date of Patent: Apr. 27, 1999

[54] SWITCH BREAKER HAVING AN ARC PREVENTION MECHANISM

[76] Inventor: Tsung-Mou Yu, No. 4, Alley 2, Lane 23, Sec. 3, Pa Te Road, Panchiao, Taipei, Taiwan

[21] Appl. No.: 09/009,593

[22] Filed: Jan. 20, 1998

[51] Int. Cl.[6] ..... H01H 85/00

[52] U.S. Cl. ..... 337/8; 337/66

[58] Field of Search ..... 337/1–3, 8–9, 337/11, 12, 13, 34, 42, 43, 66, 35

[56] References Cited

U.S. PATENT DOCUMENTS 4,570,142 2/1986 Ineichen et al. ..... 337/66

4,833,439 5/1989 Bowden et al. ..... 337/68

*Primary Examiner*—Lincoln Donovan

[57] ABSTRACT

A switch breaker includes having a body; a press button having a link; a metal sheet having an electrical contact; a elastic member; a first terminal having a point contact; a second terminal; and a cover, characterized in that a protrudent part is formed on a suitable place on the metal sheet. After one end of the press button is pressed, the insulator does not push the protrudent part of the metal sheet so that the electrical contact contacts the point contact and the switch breaker is at a conducting state. When the current load is too large and the metal sheet is too hot and bent, or when the other end of the press button is pressed and the insulator pushes the protrudent part, the electrical contact is separated from the point contact and the switch breaker is at a nonconducting state. The design of pushing the protrudent part backward by the insulator to move the left end of the metal sheet backward can prevent the occurrence of arc between the electrical contact and the point contact. Further, because the insulator presses the protrudent part and does not contact the electrical contact and point contact, the electrical contact and point contact are not worn away. Therefore, the life of the switch breaker is extended.

2 Claims, 4 Drawing Sheets

NON-CONDUCTING STATE

FIG 2 NON-CONDUCTING STATE

FIG 3 CONDUCTING STATE

SWITCH BREAKER HAVING AN ARC PREVENTION MECHANISM

FIELD OF THE INVENTION

This invention relates to a switch breaker, particularly to a breaker in which a protrudent part is formed on the metal sheet in order to prevent the occurrence of arc and the wearing damage of the electrical contact and the point contact in the breaker. The life of the switch breaker is extended.

BACKGROUND OF THE INVENTION

Conventionally, the so-called breaker is used to prevent the electrical equipments from being damaged by an overcurrent. However, the breaker which is expensive and different from a switch should be additively mounted. Therefore, a switch in which an automatic breaker is directly disposed in an electrical switch has been made in the art. The switch comprises a main body, a switching button which is pivotably mounted on the top of the main body, an insulating sheet having a through hole thereon that is pivotably mounted at the bottom of one end of the switching button, a torsion spring which is disposed at the bottom of the switching button and between the switching button and the one inner side of the main body, two terminal sheets which extend vertically through the bottom of the main body, and a metal sheet which is secured to one of the terminal sheets. A first metal contact point is disposed at one end of the metal sheet and a second metal contact point is disposed at the other end of the metal sheet on the opposite side. The insulating sheet can be inserted between the first metal contact point and a third contact point. The first metal contact point is moved through the through hole and contacts the third contact point. Then, the switch is turned on. When a current load is beyond a safety limit, the metal sheet is bent and the switch breaks.

In the switch breaker described above, the switch breaks when the insulating sheet is moved to a location between the first metal contact point and the third contact point. The insulating sheet is used to separate the two contact points. However, when the switch is turned on, the two contact points which are separated from each other generate arc therebetween, which can damage the contacting area of the two contact points. After a while, the two contact points become less conductive because of the arc. Furthermore, the insulating sheet is used to directly separate the two contact points. The two contact points are worn away by the insulating sheet because the insulating sheet usually hits the two contact points. This results in a poor conductivity of the two contact points.

SUMMARY OF THE INVENTION

It is an object of the present invention to provide a switch breaker in which an automatic breaker is disposed in the body. When the current load is beyond a safety load limit, the switch breaker automatically breaks so as to protect the circuit from being overloaded.

It is another object of the present invention to provide a switch breaker in which a protrudent part is formed on the metal sheet in order to prevent the occurrence of arc and the wearing damage of the electrical contact and the point contact. The life of the switch breaker is extended.

It is another object of the present invention to provide a switch breaker which comprises an elastic member. With the help of the elastic force of the elastic member on one side of the press button, the insulator is moved to a place right in front of the pushing protrudent in order to confirm that the electrical contact is separated from the point contact.

It is another object of the present invention to provide a switch breaker which comprises a metal sheet in the body as the automatic breaker. When an electrical current flowing through the metal sheet is too large, the metal sheet becomes hot and thus bent. Then, the electrical contact is separated from the point contact and the breaker is in a nonconducting state.

BRIEF DESCRIPTIONS OF THE DRAWINGS

FIG. 1 is an exploded view of the switch breaker of the present inventions.

FIG. 2 front schematic view of the switch breaker of the present invention showing that the insulator presses the protrudent part of the metal sheet and the switch breaker is in a nonconducting state after the end of the press button which is near the elastic sheet is pressed.

DETAILED DESCRIPTIONS OF THE INVENTION

Figure 1:
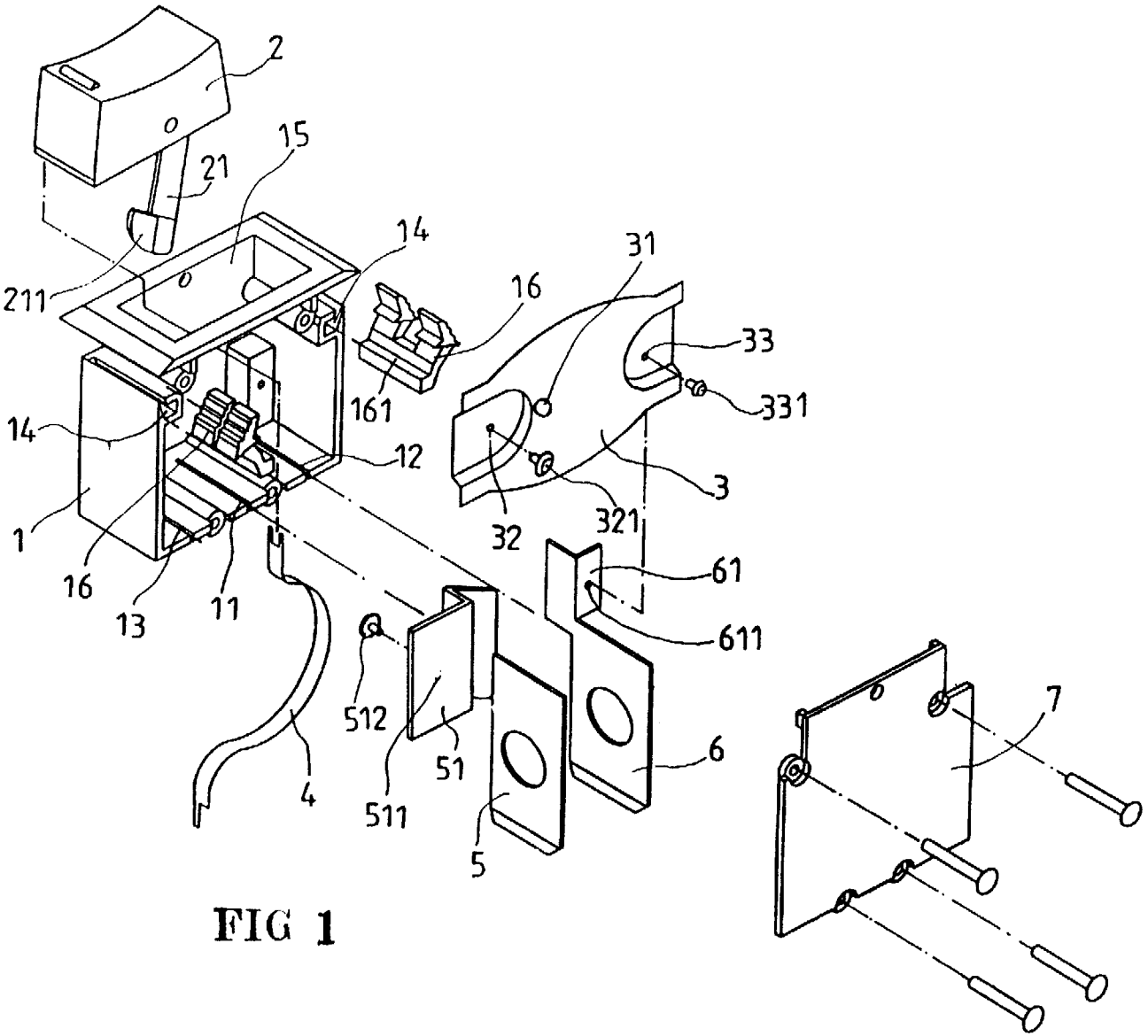

With reference to FIG. 1, the switch breaker of the present invention comprises a body 1, a press button 2, a metal sheet 3, an elastic sheet 4 (elastic member), a first terminal 5, a second terminal 6, and a cover 7. The body 1 is a hollow housing having a cavity for containing the other components of the switch breaker. A first groove 11, a second groove 12 and a third groove 13 are formed at the suitable places of the bottom of the body 1. A through hole 15 is formed on the top of the body 1. A pair of engaging slots 14 are formed at the right and left sides of the body 1. The switch breaker comprises a pair of securing objects 16 each of which has a securing protrudent portion 161 which can be inserted into the engaging slot 14 for fixing the securing object 16 to the body 1. The switch breaker of the present invention is fixed to the seat (not shown) of a breaker by means of insertion and engagement of the securing objects 16 to the seat. The press button 2 is pivotably mounted on the top of the body 1. The user can access the press button 2 through the through hole 15 because the press button 2 is exposed. A link 21 is disposed at the bottom of the press button 2. An insulator 211 is disposed at the lower end of the link 21. The elastic sheet 4 can be pressed into an arc shape. The upper end of the elastic sheet 4 is fixed to one side of the press button 2 and the lower end of the elastic sheet 4 is engaged into the third groove 13 of the body 1. The left side of the press button 2 is pushed upward by the elastic force exerted by the compressed elastic sheet 4. The radius of the curvature of the metal sheet 3 varies according to the temperature thereof, and the metal sheet 3 is made of an alloy which changes the radius of curvature at different temperatures. A first pore 32 and a second pore 33 are formed at the suitable place at opposite sides of the metal sheet 3. A protrudent part 31 is formed on a suitable place of the metal sheet 3 by pressing. A first panel 51, on which a first contact hole 511 is formed, is formed on the first terminal S. A second panel 61, on which a second contact hole 611 is formed, is formed on the second terminal 6. The right side o the metal sheet 3 is fixed to the body 1 by means of the second terminal 6 and can not be moved. The right side of the metal sheet 3 is secured to the second panel 61 of the second terminal 6 by inserting a rivet 331 through the second pore 33 and the second contact hole 611, the second terminal 6 is fixed to the body 1 by engaging and inserting it into the second groove 12 of the body 1. An electrical contact 321 which is inserted through the first pore 32 on the left side of the metal sheet 3, is fixed to left side by soldering. The bending of the metal sheet 3 moves the electrical contact 321 forward and backward. A point contact 512 which is inserted through the first contact hole 511 on the first panel 51, is fixed to first panel 51 by soldering. The first terminal 5 is engaged and inserted into the first groove 11 of the body 1. Finally, a cover 7 covers the opening of the body 1 by riveting. Then, the switch breaker is assembled as shown in FIGS. 2 and 3.

Figure 2:
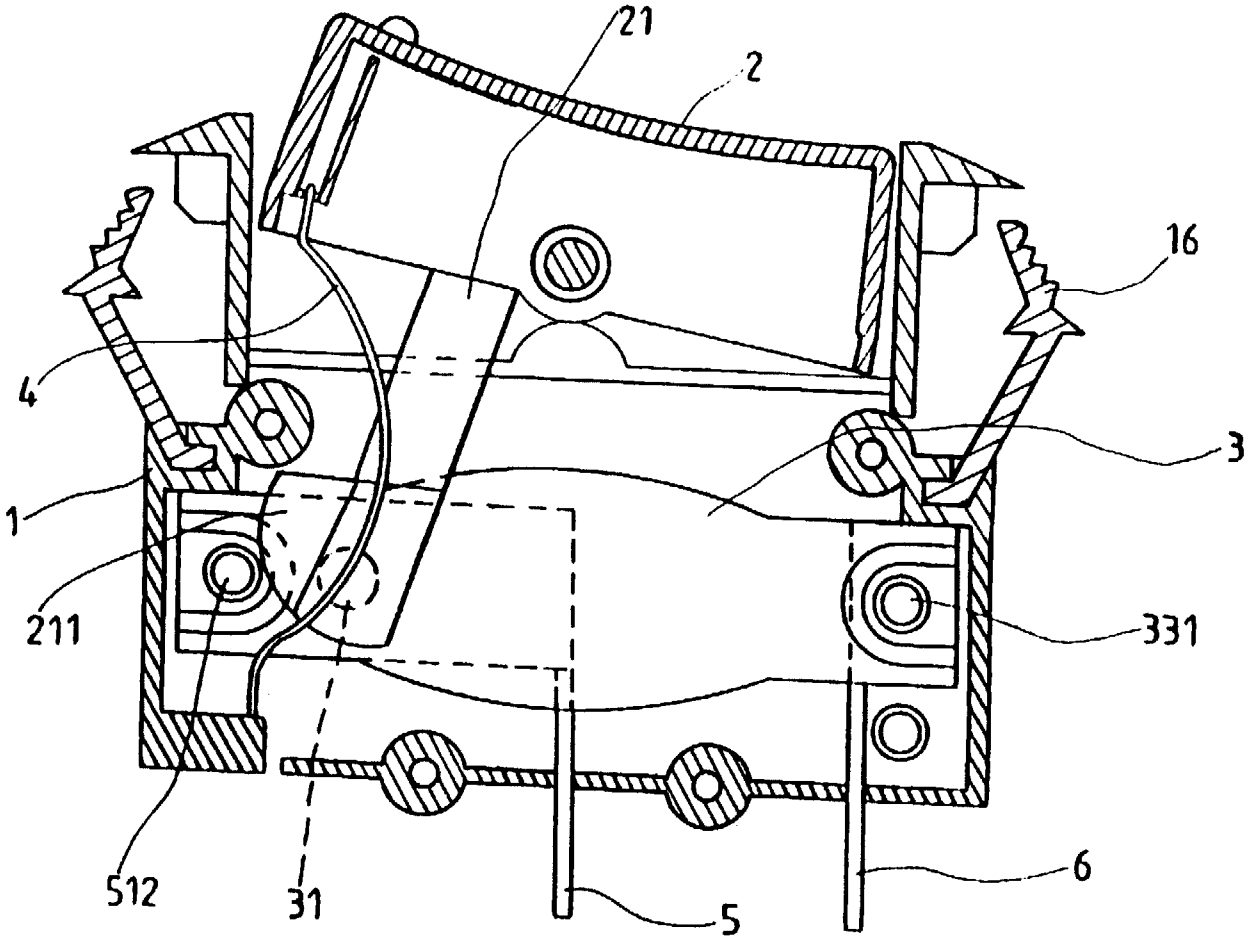
Figure 3:
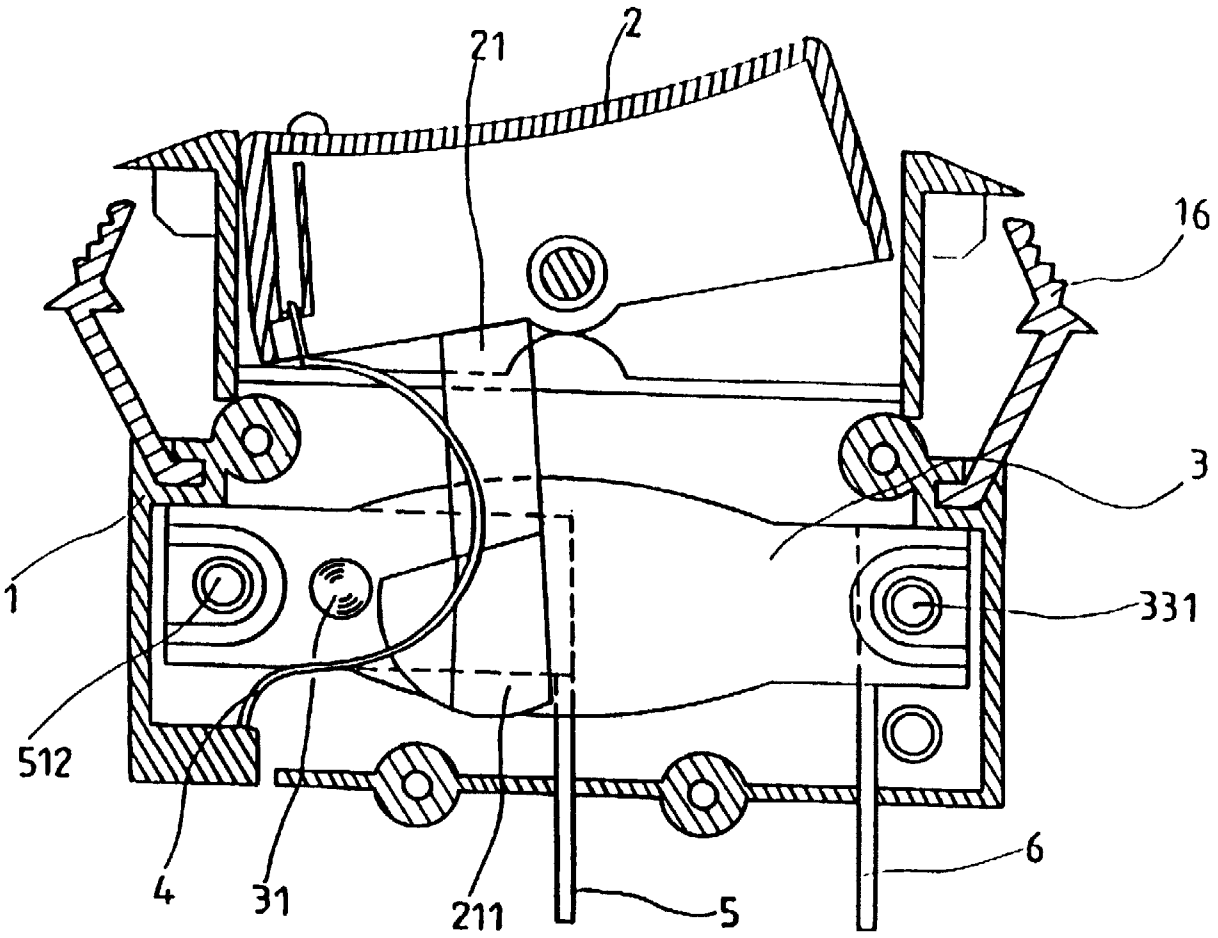
FIG. 3 is a front schematic view of the switch breaker of the present invention showing that the insulator does not press the protrudent part of the metal sheet and the switch breaker is in a conducting state after the other end of the press button is pressed.
Figure 4:
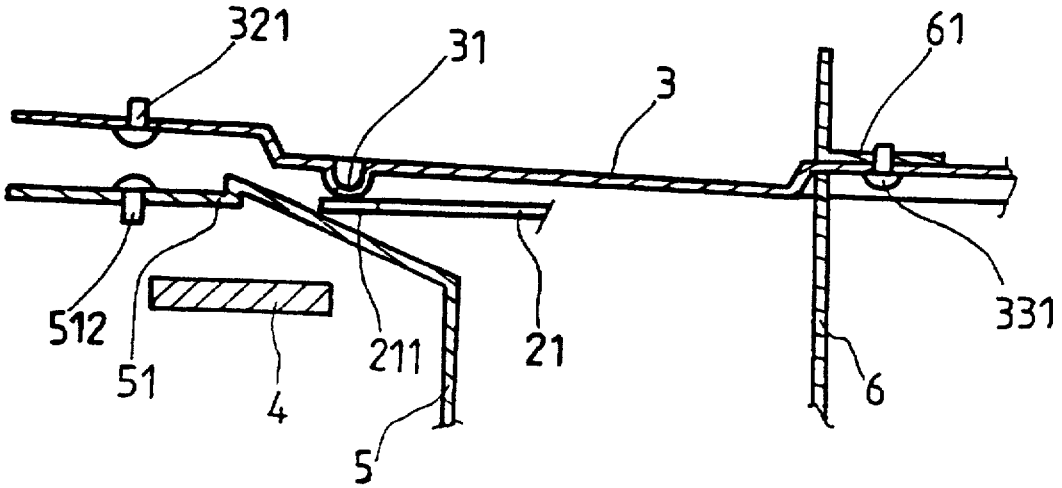
FIG. 4 is a top view of FIG. 2 showing that the insulator presses the protrudent part of the metal sheet and that the electrical contact of the metal sheet is separated from the point contact of the first terminal.
Figure 5:
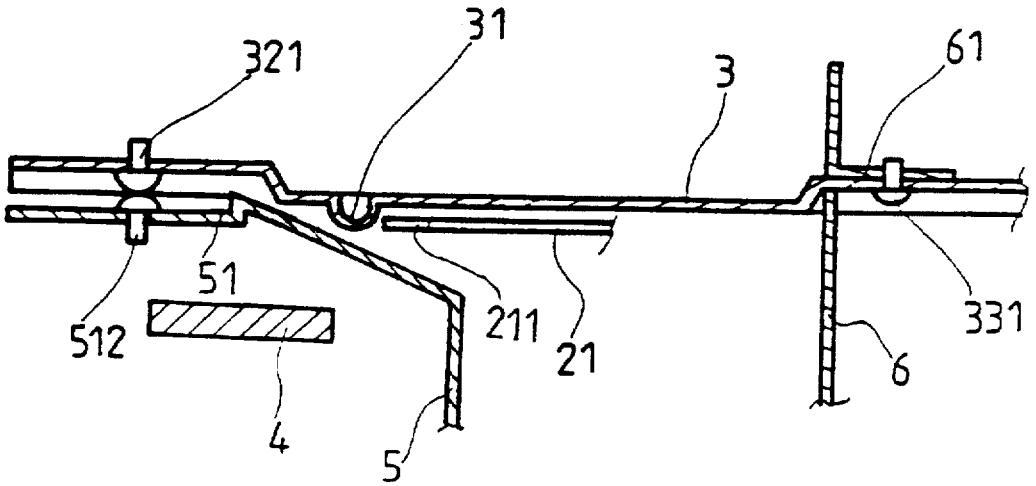
FIG. 5 is a top view of FIG. 3 showing that the insulator does not press the protrudent part of the metal sheet and that the electrical contact of the metal sheet contacts with the point contact of the first terminal.

After assembling, the state of the switch breaker can be at a nonconducting state (as shown in FIGS. 2 and 4) or at a conducting state (as shown in FIGS. 3 and 5). If an electrical current can flow from the first terminal 5 to the second terminal 6, the switch breaker is at a conducting state. On the contrary, if the electrical current can not flow from the first terminal 5 to the second terminal 6, the switch breaker is at a nonconducting state. First, we assume that the switch breaker is at a nonconducting state as shown in FIGS. 2 and 4, and the link 21 is moved to a place right in front of the protrudent part 31 between the metal sheet 3 and the first terminal 5. After the end of the press button 2 at which the elastic sheet 4 is disposed, is pressed, the insulator 211 does not push the protrodent part 31 of the metal sheet 3 backward so that the electrical contact 321 contacts the point contact 512 and the switch breaker is at a conducting state as shown in FIGS. 3 and 5. When the current load is too large and the metal sheet 3 is hot and bent backward, or when the other end of the press button 2 is pressed and the insulator 211 pushes the protrudent part 31 backward, the electrical contact 321 is separated from the point contact 512, and the switch breaker is at a nonconducting state as shown FIGS. 2 and 4. With the help of the extension elastic force of the elastic sheet 4 on the left side of the press button 2, the insulator 211 is moved to a place right in front of the protrudent part 31 in order to confirm that the electrical contact 321 is separated from the point contact 512 as shown in FIGS. 2 and 4. The function of protecting circuit is achieved. The design of pushing the pushing protrudent 31 backward by the insulator 211 to move the left end of the metal sheet 3 backward, can prevent the occurrence of arc between the electrical contact 321 and the point contact 512. Further, because the insulator 211 presses the protrudent part 31 and does not contact the electrical contact 321 and point contact 512, the electrical contact 321 and point contact 512 may not be worn away. Therefore, the life of the switch breaker of the present invention is extended.

While the invention has been, particularly shown and described with reference to these preferred embodiments, it will be understood by those skilled in the art that various changes in form and details may be made without departing from the spirit and scope of the invention. Although only the preferred embodiments of this invention were shown and described in the above description, it is requested that any modification or combination that comes within the spirit of this invention be protected.

I claim:

1. A switch breaker comprising:

a body including a top cover having a through hole;

a first terminal being fixed to said body and having a point contact;

a second terminal being fixed to said body;

a metal sheet having a first end fixed to said second terminal, a second end having an electrical contact formed thereon for contacting said point contact, and a protrudent part formed near said electrical contact, said metal sheet being bent for breaking the contact between said electrical contact and said point contact if an overloading current is flowing through said metal sheet;

a press button having a link for preventing said electrical contact from contacting said point contact if said link is placed in front of said protrudent part by pressing said press button, said press button being pivotally mounted on said body and exposed through said through hole; and an elastic member having a first end fixed to said press button and a second end fixed to said body, said elastic member pushing said press button for placing said link in front of said protrudent part and preventing arc generation between said electrical contact and said point contact when said metal sheet is hot and bent due to an overloading current;

wherein said electrical contact contacts said point contact when said switch breaker is in a conducting state, and said link prevents said electrical contact from contacting said point contact when said switch breaker is in a non-conducting state.

2. The switch breaker as claimed in claim 1, wherein said protrudent part is made by pressing.

* * * * *